United States Patent [19]

Lindell et al.

[11] 3,986,798

[45] Oct. 19, 1976

[54] PISTON COMPRESSOR

[75] Inventors: Nils Lindell, Antwerp; Carl Gustav Rådmark, Wilrijk, both of Belgium

[73] Assignee: Atlas Copco Aktiebolag, Nacka, Sweden

[22] Filed: Aug. 21, 1974

[21] Appl. No.: 499,223

[30] Foreign Application Priority Data

Aug. 21, 1973 United Kingdom ..... 39632/73

[52] U.S. Cl. ..... 417/564; 123/41.68; 92/144

[51] Int. Cl.[2] ..... F04B 21/02; F01P 1/02

[58] Field of Search ..... 417/563, 564, 437, 571; 92/144; 123/41.68

[56] References Cited

UNITED STATES PATENTS

| | | | |
|---|---|---|---|
| 1,584,787 | 5/1926 | Marshall | 417/564 |
| 1,740,108 | 12/1929 | Marshal | 417/567 |
| 1,886,359 | 11/1932 | Ackerman | 417/571 |
| 2,146,368 | 2/1939 | Dake | 123/41.68 |
| 2,213,258 | 9/1940 | Lamberton | 417/564 |
| 2,463,766 | 3/1949 | Hadley | 417/571 |
| 2,957,620 | 10/1960 | Turncaned | 417/454 |
| 3,220,639 | 11/1965 | Chew | 417/437 |
| 3,829,253 | 8/1974 | Burn | 417/564 |

FOREIGN PATENTS OR APPLICATIONS

| | | | |
|---|---|---|---|
| 1,102,964 | 3/1961 | Germany | 417/571 |
| 1,110,355 | 7/1961 | Germany | 417/571 |
| 1,107,021 | 11/1957 | Germany | 123/41.68 |

*Primary Examiner*—William L. Freeh
*Attorney, Agent, or Firm*—Eric Y. Munson

[57] ABSTRACT

A piston compressor is disclosed which comprises a cylinder head having a channel of essential length for cooling the compressed fluid before it leaves the compressor.

7 Claims, 4 Drawing Figures

PISTON COMPRESSOR

This invention relates to reciprocating piston compressors which are air cooled.

According to the invention, there is provided an air cooled piston compressor comprising a cylinder, an outlet valve for controlling the outlet of compressed fluid from the cylinder, a piston arranged for reciprocating movement in the cylinder, and a cylinder head forming an outlet chamber around said outlet valve, said cylinder head comprising a heat dissipating and conveying means, of substantial length, for conveying compressed fluid from said outlet chamber to an outlet terminal.

The heat dissipating and conveying means may form pressure smoothing means, and to this end they may be in the form of a spiral passage.

The invention will now be further described, by way of example, with reference to the accompanying drawings in which.

Figure 1:
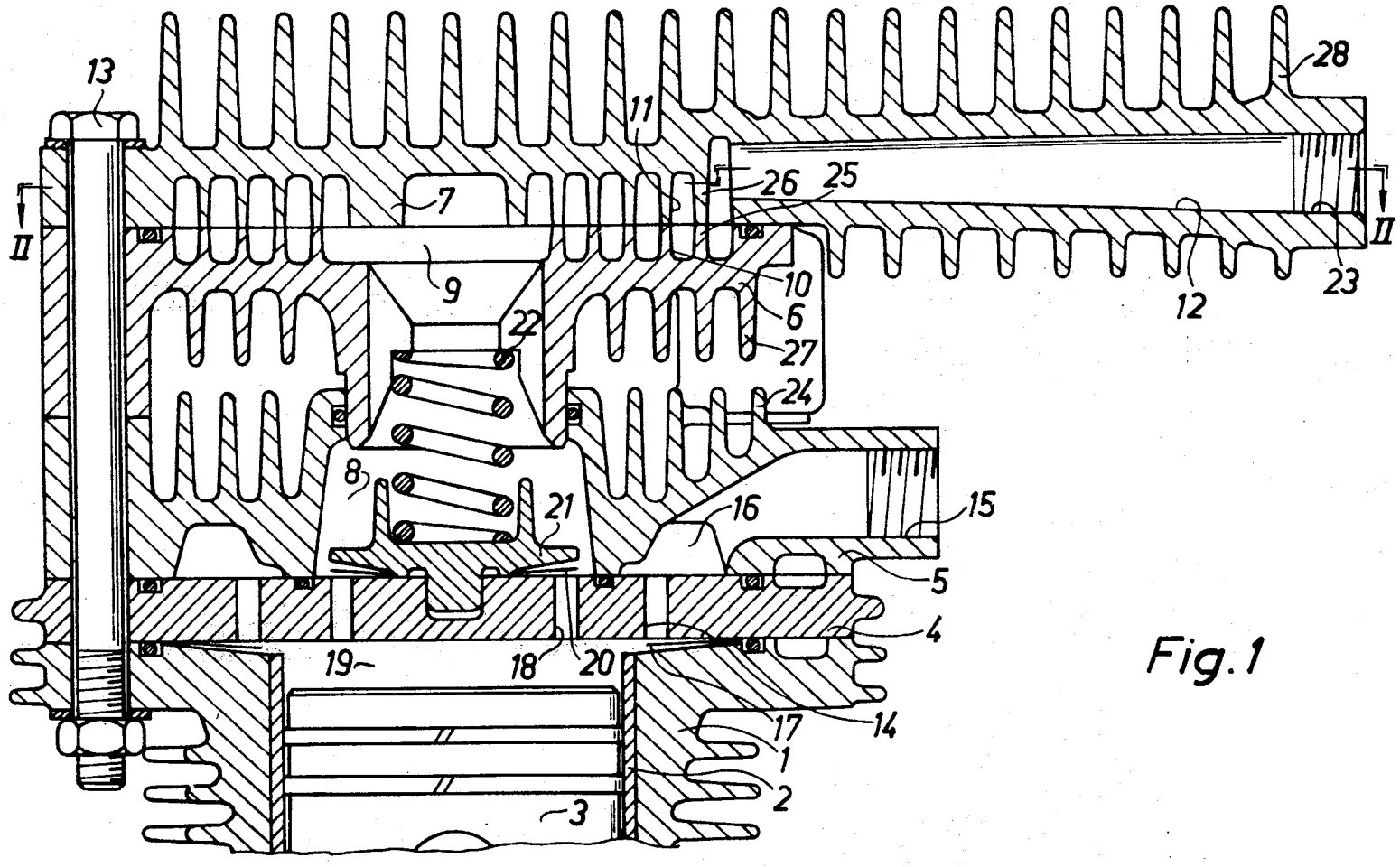
FIG. 1 is a section through a piston compressor cylinder and cylinder head incorporating the invention taken at I—I in FIG. 2.

FIG. 1 shows a cylinder 1 with a cylinder lining 2 and a piston 3 which can move reciprocably in the cylinder lining 2.

Above the cylinder 1 is a valve seat 4, and a cylinder head built up of a lower part 5, a middle part 6 and an upper part 7. The lower part 5 contains the gas inlet to the inlet valve. The lower part 5, the middle part 6 and the upper part 7 together form a chamber 8, 9 which is vented through an extended channel 10, 11, 12 which takes care of the gas pulsations and removes some of the heat already in the cylinder head 5, 6, 7. A number of bolts 13 clamp the three parts of the cylinder head 5, 6, 7 and the valve seat 4 to the cylinder 1.

The valve seat 4 has passages 14 for passage of suction gas from the inlet terminal 15 and the inlet chamber 16 of the cylinder head lower part 5 which are controlled by a valve disc 17 between the cylinder 1 and the valve seat 4 to form inlet valves. The valve seat 4 has also passages 18 for passage of compressed gas from the cylinder compression chamber 19 to the lower outlet chamber volume 8 of the cylinder head lower part 5 controlled by a valve disc 20 between the valve seat 4 and the valve guard 21. The valve guard 21 keeps the valve disc 20 against the valve seat 4 because the guard is held by a spring 22 supported in the valve head middle part 6.

In the middle part 6 is an upper outlet chamber 9 which connects with the spiral passage 11 in the upper part 7 and the corresponding spiral passage 10 in the middle part 6. In the upper part 7 is a passage 12 from the spiral passage 11 to the outlet terminal 23.

The cylinder head is, in the normal way, provided with cooling fins 24 to help in cooling.

The walls 25, 26, forming the spiral passages 10, 11 will absorb heat from the compressed gas passing through and convey the heat to parts 6, 7 and then to cooling fins 27, 28. Between the cooling fins 24 and 27, a passage for cooling air is provided in, and extending through, the cylinder head.

Figure 2:
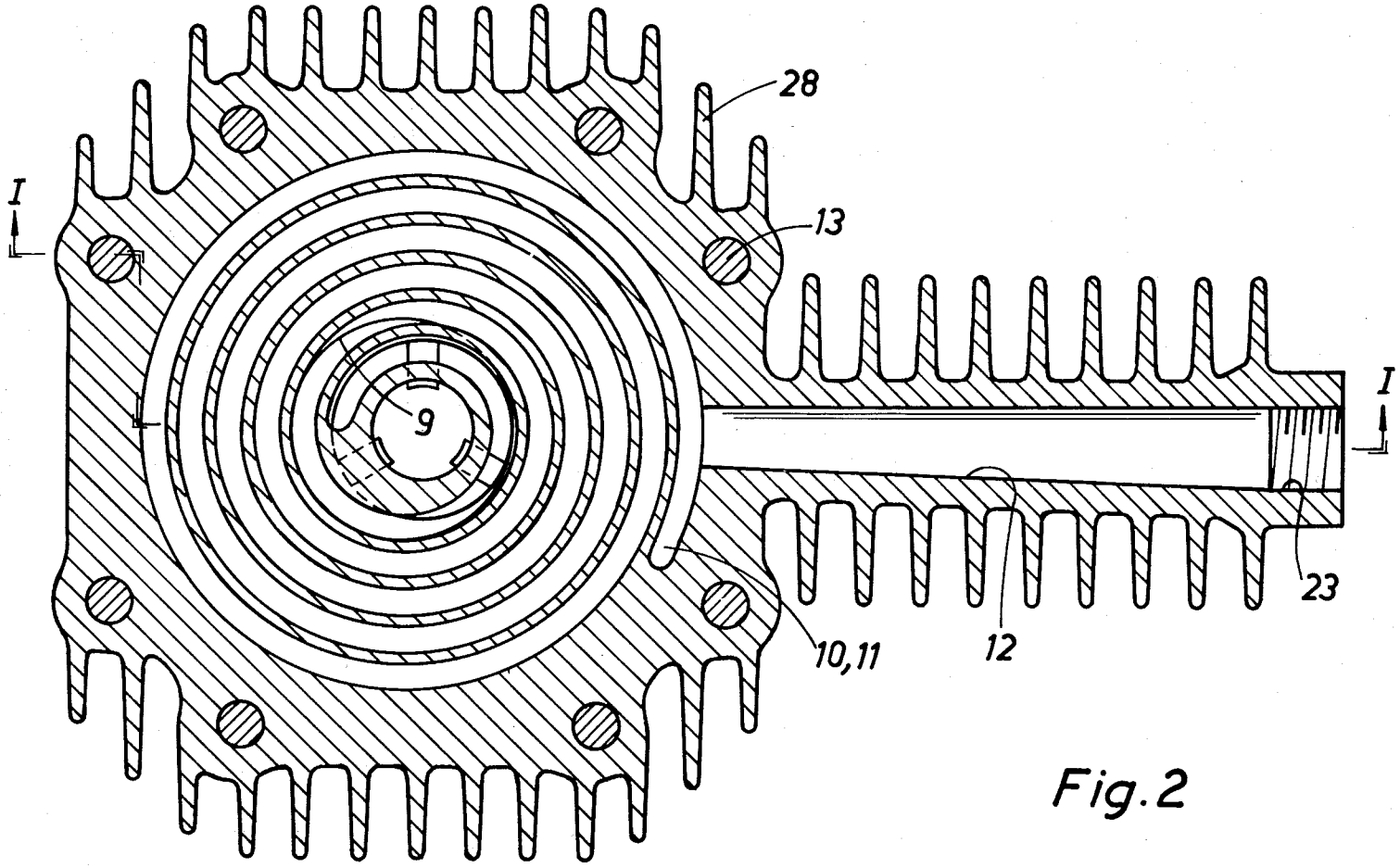
FIG. 2 is a section through the upper part of the cylinder head taken perpendicular to the cylinder bore axis at II—II in FIG. 1.

In FIG. 2 the compressed gas enters the spiral passages 10, 11 from the upper outlet chamber 9 in the middle part 6 of the cylinder head. From the spiral passage 11 the pressure-smoothed and cooled compressed gas passes through the passage 12 to the outlet terminal 23.

Eight clamping bolts 13 are shown as are also the cooling ribs 28. The direction of the cooling ribs can, of course, run in any direction.

Figure 3:
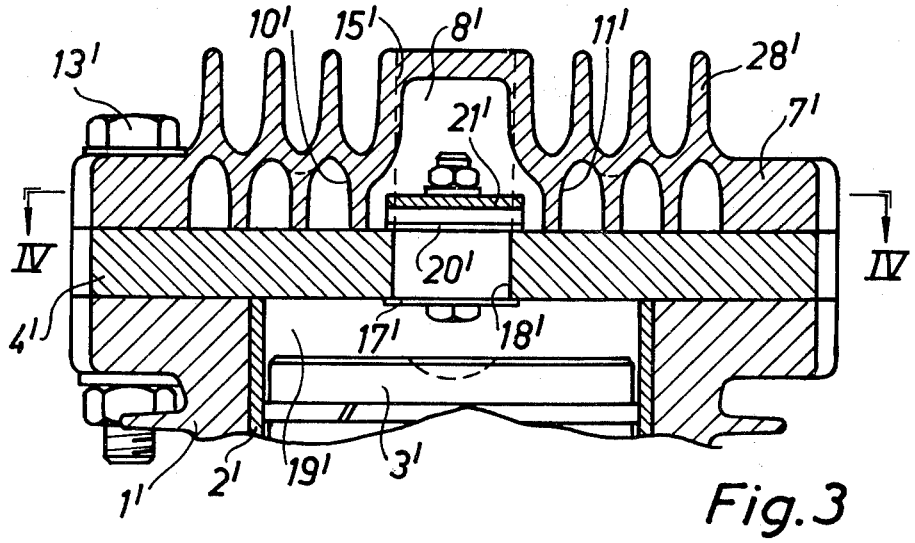
FIG. 3 is a view similar to that of FIG. 1 showing a second embodiment of the invention, and taken on the line III—III in FIG. 4.
Figure 4:
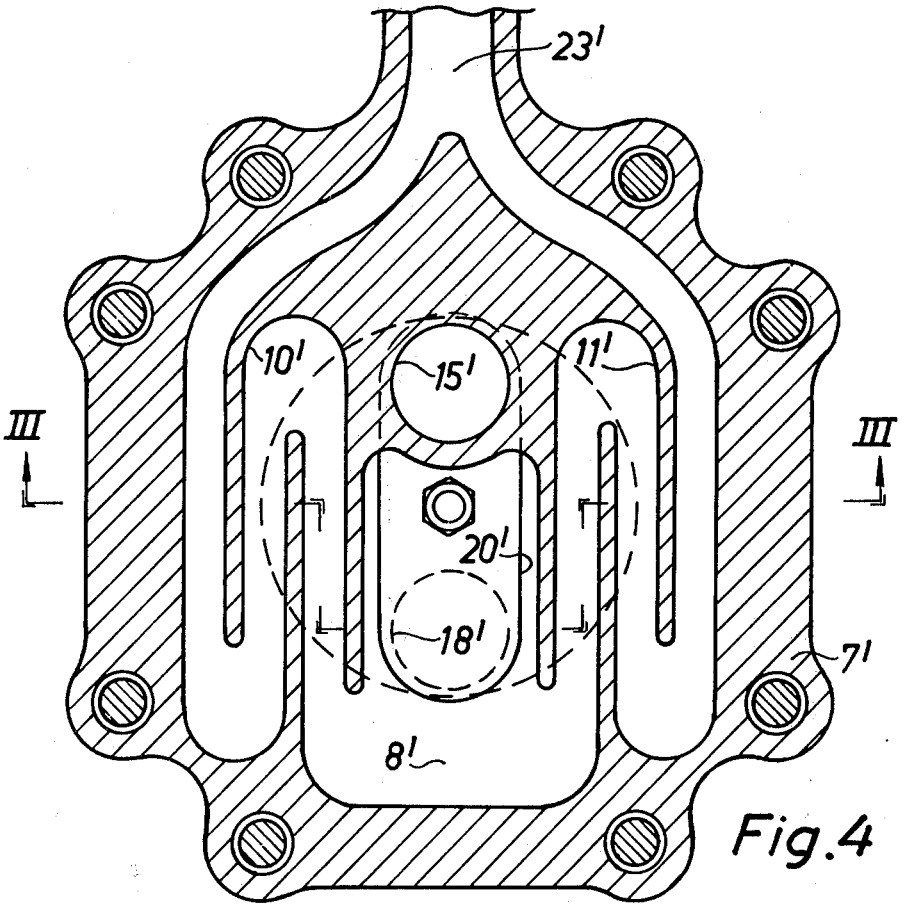
FIG. 4 is a view on the line IV—IV in FIG. 3.

FIG. 3 shows a second embodiment with a cylinder $1^1$, a cylinder lining $2^1$, and a piston $3^1$. On the top of the cylinder $1^1$ is a valve seat $4^1$ and a cylinder head $7^1$. The cylinder head has an inlet passage $15^1$ for suction gas which extends through the valve seat $4^1$ to the inlet valve disc $17^1$. From the cylinder compression chamber $19^1$ a passage $18^1$ extends through the valve seat $4^1$ to the valve disc $20^1$ with a valve guard $21^1$. The cylinder head $7^1$ has an outlet chamber $8^1$ which connects via zig-zag passages $10^1$ and $11^1$ with an outlet from the cylinder head (FIG. 4). A number of bolts $13^1$ hold the cylinder head $7^1$, the valve seat $4^1$ and the cylinder $1^1$ together. The cylinder head $7^1$ is provided with cooling ribs $28^1$.

FIG. 4 shows the inlet passage $15^1$ for suction gas, the outlet passage $18^1$ through the valve seat $4^1$ to the outlet valve disc $20^1$, the outlet chamber $8^1$ in the cylinder head $7^1$ and the zig-zag passages $10^1$ and $11^1$ leading to the outlet $23^1$.

The value of the hydraulic diameter can be calculated from $$d_h = 4A/O$$

$d_h$ = the hydraulic diameter
$A$ = the cross-sectional area
$O$ = the circumference of the cross-sectional area.

What we claim is:

1. In a compressor:

a. a cylinder and a piston arranged for reciprocating movement within said cylinder;

b. inlet passage means connected to said cylinder including valve means for controlling the flow of fluid into said cylinder to be compressed therein by the reciprocation of said piston;

c. a cylinder head connected to said cylinder comprising an outlet passage for the compressed fluid and forming a chamber for receiving compressed fluid from said cylinder and conveying it to said outlet passage;

d. valve means arranged between said cylinder and said cylinder head controlling the passage of compressed fluid into said chamber; and e. means for removing heat from said compressed fluid comprising spaced wall members in said cylinder head forming an enclosed multi-convolution spiral passage for conveying compressed fluid from said chamber to said outlet passage.

2. A compressor according to claim 1, in which the volume of said chamber is at least 25% of the volume swept by the piston.

3. A compressor as claimed in claim 1, in which said heat removing means has a length which is at least ten times its hydraulic diameter.

4. A compressor according to claim 1, in which said heat removing means also comprise a plurality of cooling fins projecting from the exterior walls of said cylinder head.

5. A compressor according to claim 4, in which said cooling fins form a passage about said chamber for passing a cooling medium therethrough.

6. A compressor according to claim 4, in which said chamber comprises two intercommunicating portions, the portion remote from said cylinder being connected to said spiral passage.

7. A compressor according to claim 6, in which said cooling fins form a passage about the portion of said chamber adjacent the cylinder for passing a cooling medium therethrough.

* * * * *